US010228180B2

(12) United States Patent
Oyu et al.

(10) Patent No.: US 10,228,180 B2
(45) Date of Patent: Mar. 12, 2019

(54) SHIELDING DEVICE AND REFRIGERATOR COMPRISING SAME

(71) Applicants: HAIER ASIA INTERNATIONAL CO., LTD., Osaka-shi, Osaka (JP); QINGDAO HAIER JOINT STOCK CO., LTD., Qingdao, Shandong (CN)

(72) Inventors: Hideki Oyu, Osaka (JP); Toshiharu Kuratani, Osaka (JP); Takaya Tateno, Osaka (JP); Tatsuhiko Yamaguchi, Osaka (JP)

(73) Assignees: HAIER ASIA INTERNATIONAL CO., LTD., Osaka (JP); QINGDAO HAIER JOINT STOCK CO., LTD., Qingdao, Shandong (CN)

( * ) Notice: Subject to any disclaimer, the term of this patent is extended or adjusted under 35 U.S.C. 154(b) by 369 days.

(21) Appl. No.: 15/015,805

(22) Filed: Feb. 4, 2016

(65) Prior Publication Data

US 2016/0153693 A1 Jun. 2, 2016

Related U.S. Application Data

(63) Continuation of application No. PCT/CN2014/086859, filed on Sep. 18, 2014.

(30) Foreign Application Priority Data

Sep. 24, 2013 (JP) ..... 2013-197002

(51) Int. Cl.
*F25D 17/04* (2006.01)
*F25D 17/06* (2006.01)
(Continued)

(52) U.S. Cl.
CPC ..... *F25D 17/045* (2013.01); *F25D 17/065* (2013.01); *F25D 17/067* (2013.01);
(Continued)

(58) Field of Classification Search
CPC .... F25D 17/045; F25D 17/065; F25D 17/067; F25D 17/08; F25D 21/06; F25D 2317/0681
See application file for complete search history.

(56) References Cited

U.S. PATENT DOCUMENTS 3,103,797 A * 9/1963 Harley, Jr. ..... F25D 11/022 62/140
3,375,677 A * 4/1968 Bright ..... F25D 17/065 62/186
(Continued)

FOREIGN PATENT DOCUMENTS

CN 1197192 A 10/1998
CN 1206099 A 1/1999
(Continued)

OTHER PUBLICATIONS

State Intellectual Property Office of the P.R. China (ISR/CN), "International Search Report for PCT/CN2014/086859", China, dated Dec. 24, 2014.

*Primary Examiner* — Christopher R Zerphey
*Assistant Examiner* — Martha Tadesse
(74) *Attorney, Agent, or Firm* — Tim Tingkang Xia, Esq.; Locke Lord LLP

(57) ABSTRACT

The disclosure relates to a shielding device for closing a path through which air circulates in a refrigerator and a refrigerator having shielding device. The shielding device includes a forced draft fan cover having a threaded hole formed with a threaded slot; and a drive shaft formed with a thread being screwed with the threaded slot and extended to pass through the threaded hole, where an air duct that allows the air flows from the inside of the forced draft fan cover to the outside is provided between the drive shaft and the forced draft fan cover.

9 Claims, 10 Drawing Sheets

(51) Int. Cl.
*F25D 17/08* (2006.01)
*F25D 21/06* (2006.01)

(52) U.S. Cl.
CPC ..... *F25D 17/08* (2013.01); *F25D 21/06* (2013.01); *F25D 2317/0681* (2013.01)

(56) References Cited

U.S. PATENT DOCUMENTS

| | | | | | |
|---|---|---|---|---|---|
| 5,997,254 | A * | 12/1999 | Tosaki | F04D 29/703 | 416/247 R |
| 8,087,261 | B2 * | 1/2012 | Lee | F25B 39/022 | 454/259 |
| 9,382,909 | B2 * | 7/2016 | Hwang | F25D 17/062 | |
| 2003/0024254 | A1 * | 2/2003 | Yoshida | F25D 17/042 | 62/78 |
| 2005/0189184 | A1 * | 9/2005 | Osvatic | F25D 17/045 | 188/138 |
| 2007/0000271 | A1 * | 1/2007 | Lee | F25B 39/022 | 62/276 |
| 2007/0266718 | A1 * | 11/2007 | Lee | F25D 17/065 | 62/187 |
| 2007/0289321 | A1 * | 12/2007 | Kang | F25D 11/022 | 62/186 |
| 2009/0185907 | A1 * | 7/2009 | Yoo | F04D 25/02 | 416/204 R |
| 2014/0170954 | A1 * | 6/2014 | Hintz | A47L 15/48 | 454/251 |

FOREIGN PATENT DOCUMENTS

| | | | | |
|---|---|---|---|---|
| JP | 2005249334 | A | * | 9/2005 |
| JP | 2006300427 | A | | 11/2006 |
| JP | 2007120802 | A | | 5/2007 |
| JP | 2009250476 | A | | 10/2009 |
| KR | 20070010547 | A | * | 1/2007 |
| KR | 20080104882 | A | * | 12/2008 |
| KR | 100918447 | B1 | * | 9/2009 |
| KR | 20090099875 | A | * | 9/2009 |
| KR | 20100004810 | A | * | 1/2010 |
| KR | 20120002042 | A | * | 1/2012 |
| KR | 20140019907 | A | * | 2/2014 |
| WO | 2013135149 | A1 | | 9/2013 |

* cited by examiner

SHIELDING DEVICE AND REFRIGERATOR COMPRISING SAME

CROSS-REFERENCE TO RELATED APPLICATIONS

This application is a continuation application of International Patent Application No. PCT/CN2014/086859, filed Sep. 18, 2014, which itself claims priority to and benefit of Japanese Patent Application No. 2013-197002, filed Sep. 24, 2013, which are hereby incorporated herein in their entireties by reference.

FIELD OF THE INVENTION

The present invention relates generally to a refrigerator, and more particularly, to a shielding device that blocks an air duct where cool air circulates in a refrigerator according to needs and a refrigerator having the shielding device.

BACKGROUND OF THE INVENTION

The background description provided herein is for the purpose of generally presenting the context of the present invention. The subject matter discussed in the background of the invention section should not be assumed to be prior art merely as a result of its mention in the background of the invention section. Similarly, a problem mentioned in the background of the invention section or associated with the subject matter of the background of the invention section should not be assumed to have been previously recognized in the prior art. The subject matter in the background of the invention section merely represents different approaches, which in and of themselves may also be inventions. Work of the presently named inventors, to the extent it is described in the background of the invention section, as well as aspects of the description that may not otherwise qualify as prior art at the time of filing, are neither expressly nor impliedly admitted as prior art against the present invention.

In a conventional refrigerator, when a cooler is defrosted, there is a problem that hot air surrounding the cooler heated by a defrost heater flows into a storage chamber to raise the temperature in the storage chamber. Therefore, to prevent hot air in a defrosting operation from entering into the storage chamber, a known solution is to dispose an air door in a cooling air duct and close the air door in the defrosting operation (e.g., disclosed in Japanese Patent Publication No. JP 2009-250476).

FIG. 9 is a front view of an air duct structure of a refrigerator 100 disclosed in Japanese Patent Publication No. JP 2009-250476. In the refrigerator 100, inlet air doors 105, 106, 107 and 108 are respectively disposed in cool air supply air duct 101, 102, 103 and 104 that send cool air cooled by the cooler to the storage chamber. In addition, cool air return air ducts 109, 110 and 111 through which the cool air returns from the storage chamber to the cooler are respectively provided with outlet air doors 113, 114 and 115. Furthermore, a cool air return air duct (not shown) from a freezing chamber 112 is provided with an outlet air door 116. Moreover, in the defrosting operation, all or part of the inlet air doors 105, 106, 107 and 108 and the outlet air doors 113, 114, 115 and 116 are closed.

Another known solution, as shown in FIGS. 10A and 10B, is to dispose forced draft fans 205 and 305 in a cool air blowout port leading to the storage chamber and dispose air volume control mechanisms 200 and 300 on the forced draft fans 205 and 305 (e.g., disclosed in Japanese Patent Publication No. JP 2006-300427).

The air volume control mechanism 200 shown in FIG. 10A includes an air outside frame of the axial forced draft fan 205 mounted to one side of multiple openable and closeable plates 201, to open and close the openable and closeable plates 201 by means of driving of a small motor 204 connected via a connecting plate 202 and a rotating plate 203.

In addition, in the air volume control mechanism 300 shown in FIG. 10B, a suction side of the axial forced draft fan 305 is provided with a wind ring shield 301. The wind ring shield 301 is opened and closed by means of a solenoid 304 connected via an operating plate 302 and a connecting shaft 303.

However, as shown in FIG. 9, in the prior art refrigerators which dispose air doors in cooling air ducts, for various refrigerators designed to have different capacity and functions, it is necessary to design respective air ducts and air doors corresponding to the air ducts for each model. Therefore, if air doors adapted to various models of air ducts are disposed, the kinds of the air doors will increase, to become a multi-specification & small batch production manner, and there is a problem that development cost and production cost of the air doors increase.

In addition, as shown in FIG. 10A, in the structure that the air volume control mechanism 200 is mounted to the forced draft fan 205, there is a problem that the air volume control mechanism 200 has great flow resistance. That is, when air flowing on the air outside of the axial forced draft fan forms a rotational flow that takes the vicinity of a fan rotating shaft as a center shaft, the rotational flow will be hindered as the air volume control mechanism 200 is a structure that arranges multiple open and close plates 201 in parallel.

In addition, when the wind ring shield 301 shown in FIG. 10B is used at the air outside of the forced draft fan, there is a problem that an air-out portion of the forced draft fan has great pressure loss. That is, when air flowing on the air outside of the forced draft fan in the refrigerator has a characteristic that flow velocity in a turning radius direction is greater than that in a fan rotating shaft direction, the wind ring shield 301 will hinder flowing in the turning radius direction.

Moreover, in use of the structure of the openable and closeable plates 201 shown in FIG. 10A and the structure of the wind ring shield 301 shown in FIG. 10B, it is likely that attached moisture freezes to hinder actions thereof.

Therefore, a heretofore unaddressed need exists in the art to address the aforementioned deficiencies and inadequacies.

SUMMARY OF THE INVENTION

One of the objectives of the present invention is to provide a shielding device that effectively prevents hot air from flowing into a storage chamber during defrosting and a refrigerator having the shielding device, so as to solve the above-noted problems.

In one aspect, the present invention provides a shielding device, used for closing a path through which air circulates in a refrigerator. The shielding device includes a forced draft fan cover, which has a threaded hole formed with a threaded slot; and a drive shaft, which is formed with a thread screwed with the threaded slot, and extends to pass through the threaded hole, where an air duct that allows the air flows from the inside of the forced draft fan cover to the outside is provided between the drive shaft and the forced draft fan cover.

In one embodiment, a side surface of the thread of the drive shaft is in a tilted shape, and a radial outer side portion of the tilted shape is at a greater distance from the threaded slot of the forced draft fan cover than an inner side portion; and the air duct is formed between the side surface of the thread of the drive shaft and the threaded slot of the forced draft fan cover.

In one embodiment, the shielding device further includes a guide post, which slidably extends to pass through the forced draft fan cover.

In one embodiment, a notch portion is formed by removing one part of the forced draft fan cover which faces the threaded hole; and the notch portion makes up one part of the air duct.

In one embodiment, the shielding device further includes a support portion, which abuts against the notch portion when the forced draft fan cover closes the channel so as to close the air duct.

In one embodiment, the shielding device further includes a thick portion, which is an annular thickened part on the forced draft fan cover which surrounds the threaded hole; wherein an interrupt portion is formed by partially removing the thick portion at the end of the threaded slot.

In another aspect, the present invention further provides a refrigerator having the shielding device provided in the present invention.

According to the present invention, opening and closing actions of the forced draft fan cover are achieved through a thread mechanism screwed with a drive shaft that extends to pass through the forced draft fan cover. Moreover, an air duct that allows the air flows from the inside of the forced draft fan cover to the outside is provided between the drive shaft and the forced draft fan cover. Accordingly, even if moisture intrudes between the drive shaft and the forced draft fan cover in a use condition, the moisture will be discharged to the outside via the air duct. Thus, that moisture freezes to make the thread mechanism of the shielding device incapable of operating can be prevented.

In addition, setting a side surface of the thread of the drive shaft in a tilted shape can ensure that there is a greater gap between it and the threaded slot of the forced draft fan cover. Therefore, an effect of discharging moisture is increased.

Further, cutting a notch from one part of the forced draft fan cover ensures the air duct. Thus, a drainage effect is also increased.

Moreover, the forced draft fan cover of the present invention can move in a manner of leaving a cooling chamber, and thus flow loss of cooling air is very small. Therefore, air that has greater flow velocity in a turning radius direction of the air outside of the forced draft fan can flow into a cooling air duct through the open portion with smaller flow resistance. Therefore, pressure loss of cooling air circulating in the refrigerator can be reduced, and cooling efficiency can be increased.

These and other aspects of the present invention will become apparent from the following description of the preferred embodiment taken in conjunction with the following drawings, although variations and modifications therein may be affected without departing from the spirit and scope of the novel concepts of the invention.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment. The drawings do not limit the present invention to the specific embodiments disclosed and described herein. The drawings are not necessarily to scale, emphasis instead being placed upon clearly illustrating the principles of the invention.

FIGS. 2A-2C are views of a shielding device according to one embodiment of the present invention, wherein FIG. 2A is a sectional view of a related structure of a threaded slot and a thread, FIG. 2B is a perspective view of one part of a forced draft fan cover, and FIG. 2C is a sectional view of one part of the shielding device.

FIGS. 3A-3D are views of a shielding device according to one embodiment of the present invention, wherein FIG. 3A is a perspective view indicating that the shielding device is in a shaded state, FIG. 3B is a sectional view indicating that the shielding device is in the shaded state, FIG. 3C is a perspective view indicating that the shielding device is in a connection state, and FIG. 3D is a sectional view indicating that the shielding device is in the connection state.

FIGS. 10A-10B are views of an air volume control mechanism of another prior art refrigerator, wherein FIG. 10A is a sectional view, and FIG. 10B is a front view.

DETAILED DESCRIPTION OF THE INVENTION

Figure 1:
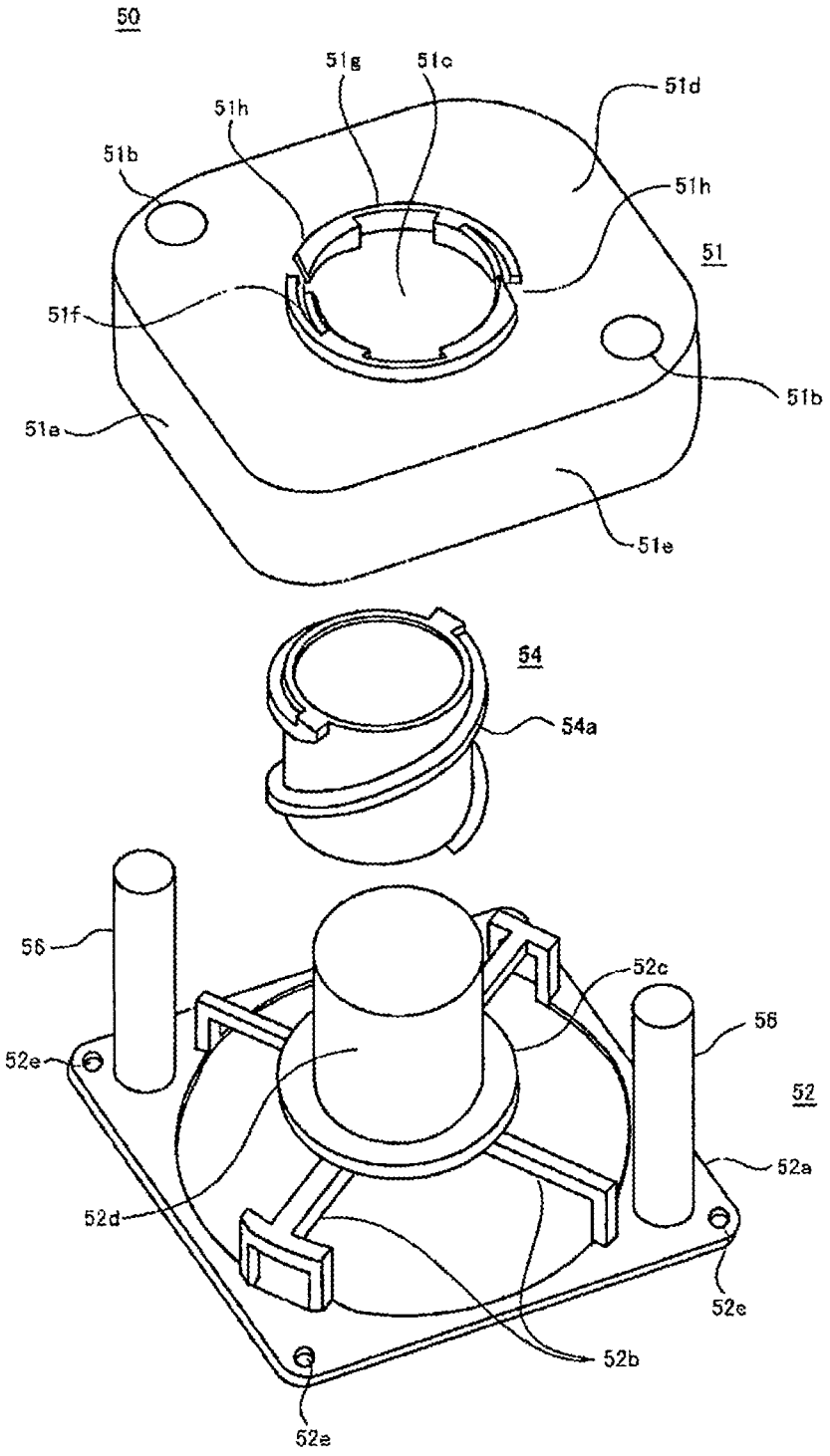
FIG. 1 is an exploded perspective view of a shielding device according to one embodiment of the present invention.

The present disclosure will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numerals refer to like elements throughout.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and in no way limits the scope and meaning of the invention or of any exemplified term. Likewise, the invention is not limited to various embodiments given in this specification.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising", or "includes" and/or "including" or "has" and/or "having" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom", "upper" or "top", and "left" and "right", may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper", depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

The description will be made as to the embodiments of the present disclosure in conjunction with the accompanying drawings. In accordance with the purposes of this disclosure, as embodied and broadly described herein, this invention, in one aspect, relates to a shielding device that blocks an air duct where cool air circulates in a refrigerator according to needs and a refrigerator having the shielding device.

First Embodiment: Structure of a Shielding Device

FIGS. 1, 2A-2C and 3A-3D show the structure of a shielding device 50 according to this exemplary embodiment of the present invention. FIG. 1 is a perspective view indicating that components of the shielding device 50 are decomposed along a longitudinal direction. FIGS. 2A-22C are diagrams of parts of the shielding device 50. FIGS. 3A-3D are diagrams of functions of the shielding device 50.

Figure 7:
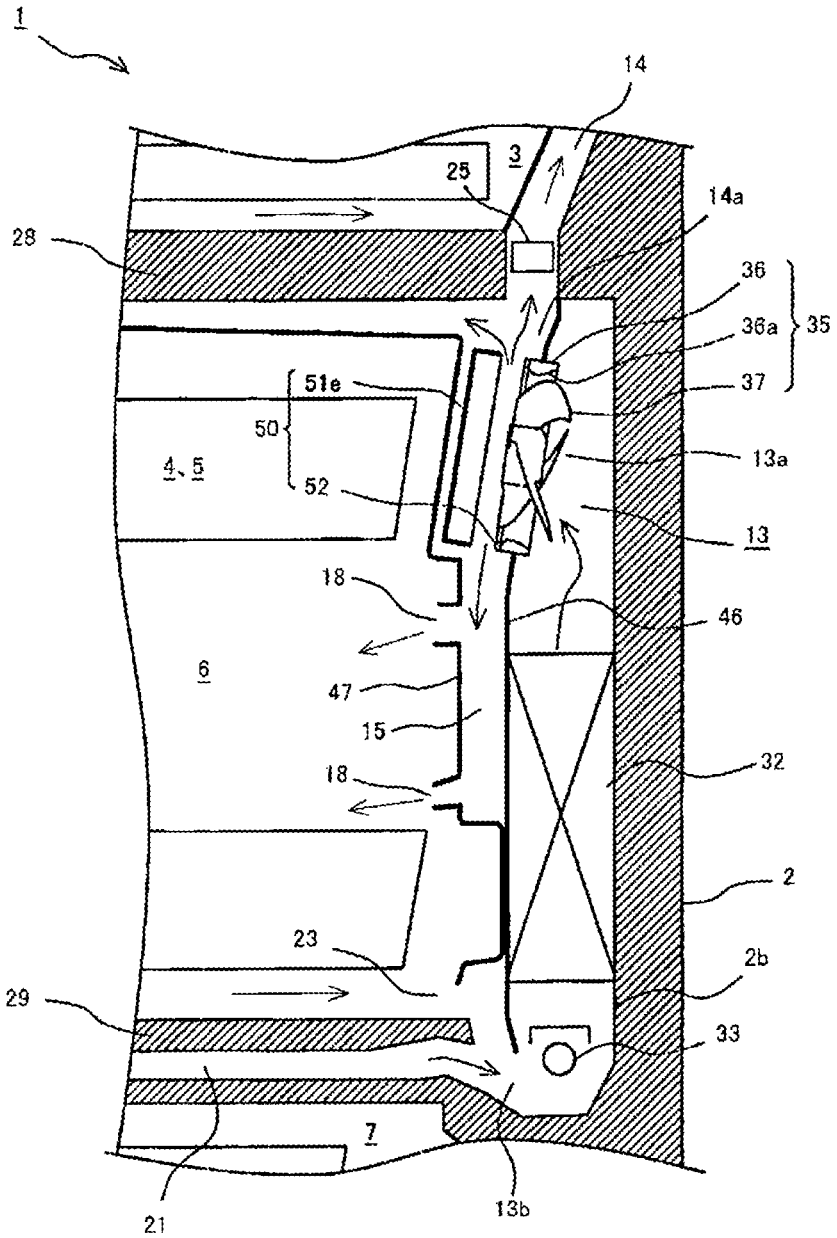
FIG. 7 is a side sectional view of a structure near a cooling chamber of a refrigerator according to one embodiment of the present invention.

Referring to FIG. 1, the shielding device 50 mainly includes a forced draft fan cover 51 substantially cover-shaped, a drive shaft 54 which extends to pass through and drives the forced draft fan cover 51, and a support base 52 used for supporting the forced draft fan cover 51 and the drive shaft 54. Referring to FIG. 7, the main function of the shielding device 50 is inhibiting hot air from leaking to a refrigerating chamber supply air duct 14 during defrosting by closing an open portion of a cooling chamber 13 in a defrosting step.

In certain embodiments, the forced draft fan cover 51 is obtained by injection-molding a resin material into a substantially cover shape, which includes a quadrilateral primary surface portion 51*d* and four side surface portions 51*e* longitudinally extending from a periphery of the primary surface portion 51*d*. In addition, a threaded hole 51*c* penetrating the vicinity of the center of the primary surface portion 51*d* and circular is formed. A peripheral part of the threaded hole 51*c* is a thick portion 51*h* thicker than other parts and ring-like. A threaded slot 51*f* is formed by recessing a side surface of the primary surface portion 51*d* facing the threaded hole 51*c* into a helical shape. In addition, a notch portion 51*g* is formed by a sidewall that penetrates the thick portion 51*h* to partially cut off the threaded hole 51*c*. As described later with reference to FIG. 7, the forced draft fan cover 51 mainly functions to basically close an air supply outlet 13*a* of the cooling chamber 13.

The drive shaft 54 is a cylindrical shape with a lower opening, which is provided with a thread 54*a*, and the thread 54*a* is formed by making one part of a side surface of the drive shaft 54 continuously project into a helical shape. In use, the thread 54*a* of the drive shaft 54 is screwed with the threaded slot 51*f* of the forced draft fan cover 51. In addition, a shaft support portion 52*d* of the support base 52 described below is inserted into the inside of the drive shaft 54, and under the action of driving force of a motor built in the shaft support portion 52*d*, the drive shaft 54 rotates a predetermined angle. The drive shaft 54 functions to open and close the forced draft fan cover 51 according to needs through rotation of the drive shaft 54 per se. An axial direction of the drive shaft 54 is basically the same as that of the fan 37 (FIG. 7) hereinafter.

The support base 52 mainly includes a frame portion 52*a* in a quadrilateral framework when overlooked, a cylindrical shaft support portion 52*d* disposed in a central portion, a ring-like annular support portion 52*c* connecting a lower end of the shaft support portion 52*d*, a support framework 52*b* connecting the annular support portion 52*c* and various corners of the frame portion 52*a* and guide posts 56 vertically disposed near opposite corners of the frame portion 52*a*.

Figure 3A:
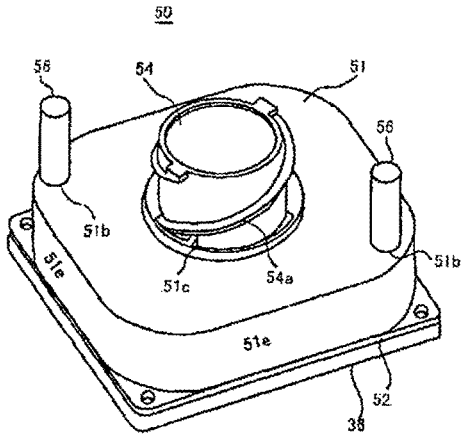
Figure 3B:
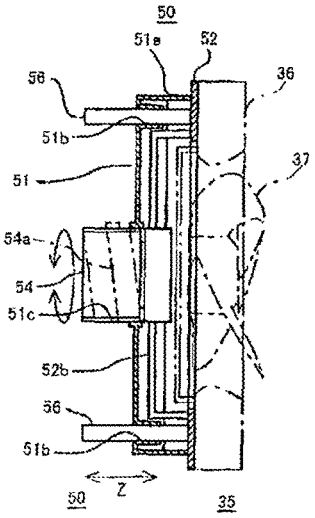

The frame portion 52*a* has a function of mechanically supporting the whole base 52, and its corner is provided with multiple holes 52*e*. As shown in FIG. 3B, the shielding device 50 including the frame portion 52*a* can be fixed to a fan shell 36 through, for example, a fixing manner such as passing through the holes 52*e* with screws.

The shaft support portion 52*d* is a cylindrical shape with an opening in a lower portion, which is connected with the frame portion 52*a* via the support framework 52*b*. The shaft support portion 52*d* is inserted into the drive shaft 54, and through driving of driving force of the motor built in the shaft support portion 52*d*, the drive shaft 54 is rotated.

The annular support portion 52*c* is a continuous ring-like part integrally formed, which is concentric with the shaft support portion 52*d*. When the forced draft fan cover 51 is closed in a use condition, the notch portion 51*g* of the forced draft fan cover is covered by the annular support portion 52*c* of the support base 52. Accordingly, hot air can be prevented from leaking via the notch portion 50*g*.

The guide posts 56 are members vertically disposed in positions corresponding to support holes 51*b* of the forced draft fan cover 51. By inserting each guide post 56 into the support hole 51*b*, movement of the forced draft fan cover 51 can be guided. As described hereinafter with reference to FIG. 2A, in this embodiment, in order to ensure that the air duct has a drainage function, a gap is disposed between the drive shaft 54 and the forced draft fan cover 51. Therefore, only through screwing between the drive shaft 54 and the forced draft fan cover 51, the support base 52 cannot stably support the forced draft fan cover 51. In this embodiment, two guide posts 56 disposed at opposite corners of the support base 52 are slidably inserted into the support holes 51*b* of the forced draft fan cover 51. In addition, the guide posts 56 are inserted into the support holes 51*b* seamlessly. Based on the structure, the support base 52 can stably support the forced draft fan cover 51.

Figure 2A:
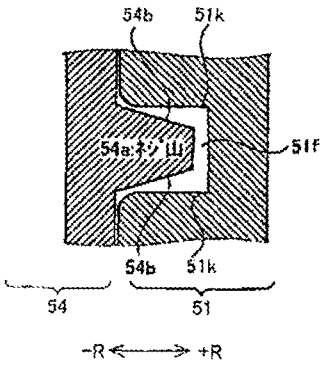
Figure 2B:
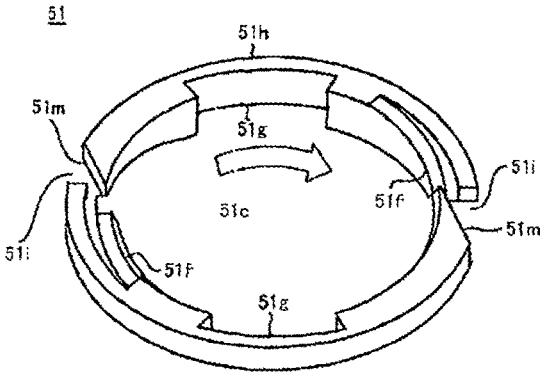
Figure 2C:
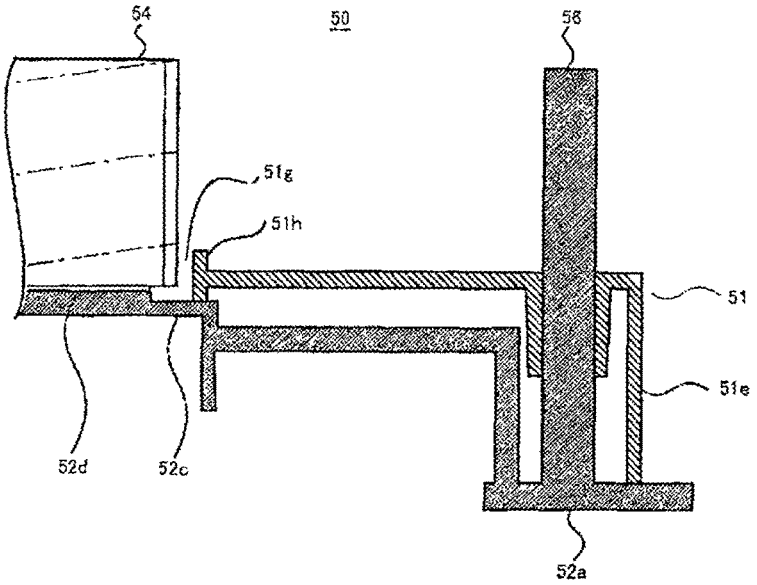

The shielding device 50 will be further described below in detail with reference to FIGS. 2A-2C. FIG. 2A is a sectional view of a threaded mechanism between the drive shaft 54 and the forced draft fan cover 51, FIG. 2B is a perspective view of one part of the forced draft fan cover 51, and FIG. 2C is a sectional view of one part of the shielding device 50.

Referring to FIG. 2A, as described above, the threaded mechanism is implemented through screwing between the thread 54*a* of the drive shaft 54 and the threaded slot 51*f* of the forced draft fan cover. Through rotation of the drive shaft 54, shading and opening of the forced draft fan cover 51 described later are achieved. As an example, a radial outward direction of a rolling circumference is taken as a +R direction, and a radial inward direction is a −R direction (or called inner side of a rotating direction).

In this embodiment, a side surface 54*b* of the thread 54*a* of the drive shaft 54 is set as a tilted surface. Specifically, the thread 54*a* includes two opposite side surfaces 54*b*, and two opposite side surfaces 51*k* are also formed on a threaded slot 51*f*. The side surfaces 54*b* of the thread 54*a* are tilted surfaces, which are at a greater distance from the side surfaces of the threaded slot 51*f* on a +R side than on a −R side (that is, the thread 54*a* narrows down along the +R direction). On the other hand, the side surfaces 51*k* of the threaded slot 51*f* are planes parallel to a primary surface of the forced draft fan cover. Moreover, there is a distance between an end portion of the +R side of the thread 54*a* and a sidewall of the threaded slot 51*f*. Accordingly, even if the drive shaft 54 is screwed to the forced draft fan cover 51, it can still ensure that there is a sufficient gap between the thread 54*a* and the threaded slot 51*f*.

The gap makes the air duct have a function of discharging moisture to the outside. Specifically, in a use condition, even if the moisture enters between the thread 54*a* and the threaded slot 51*f*, when air passes through the air duct, water can be discharged to the outside of the shielding device 50. Accordingly, an unfavorable condition that moisture freezing results in that the drive shaft 54 cannot operate can be inhibited. In addition, the screwing stated hereinabove can be implemented by making the end portion of the −R side of the thread contact an end portion of the −R side of the threaded slot 51*f*. In this way, by forming a predetermined gap between the drive shaft 54 and the forced draft fan cover 51, screwing between them becomes relaxed. However, as described above with reference to FIG. 1, the guide posts 56 of the support base 52 are inserted into the support holes 51*b* of the forced draft fan cover 51, and the forced draft fan cover 51 can be stably placed and supported by the support base 52.

Referring to FIG. 2B, the thick portion 51*h* of the forced draft fan cover 51 is provided with an interrupt portion 51*i*, which locally causes the thick portion 51*h* to have an interruption (or called discontinuity). The interrupt portion 51*i* is obtained by partially removing a thickened thickness part of the thick portion 51*h* (formed into a ring shape surrounding the threaded hole 51*c*). In addition, the interrupt portion 51*i* is formed on part of the thick portion 51*h* of the threaded slot 51*f* at the end of an upper surface side of the primary surface portion 51*d*. Moreover, a side surface 51*m* of the thick portion 51*h* facing the interrupt portion 51*i* is a tilted surface, which is tilted to a tangent direction of the threaded hole 51*c* when overlooked. In this embodiment, two threaded slots 51*f* disposed oppositely are formed with an interrupt portion 51*i* respectively.

The side surface 51*m* is a tilted surface, so that an end portion of the thread 54*a* shown in FIG. 1 and the side surface 51*m* of the forced draft fan cover 51 are in point contact, and thus moisture attached to the thread 54*a* can be well discharged to the outside via the side surface 51*m*.

In this embodiment, the side surface 51*m* faces a radial outer side. In certain embodiments, it may also face an inner side of a rotating direction. Based on the structure, a good drainage effect can be obtained through point contact with the end portion of the thread 54*a*.

Moreover, the structure the same as the thick portion 51*h*, the interrupt portion 51*i* and the side surface 51*m* may also be disposed on an inner side (and a lower surface) of the primary surface portion 51*d* of the forced draft fan cover 51. Accordingly, the drainage effect stated above will be more significant.

In the embodiment described above, the interrupt portion 51*i* is formed by removing all thickened parts of the thick portion. In certain embodiments, the interrupt portion 51*i* may also be formed by only removing one part of a thickened part of a thick wall. In this case, the interrupt portion 51*i* becomes a recessed part declined relative to other parts of the thick portion 51*h*.

Moreover, the notch portion 51*g* is formed by penetrating the thick portion 51*h* to partially remove a sidewall of the threaded hole 51*c*. The notch portion 51*g* is disposed on the opposite thick portion 51*h*, and keeps away from a part formed with the threaded slot 51*f*. In this way, by disposing the notch portion 51*g* penetrating the thick portion, moisture attached to the drive shaft 54 can be discharged to a lower surface side from an upper surface side of the forced draft fan cover 51, so as to inhibit that the moisture freezes to hinder the action of the drive shaft 54.

Referring to FIG. 2C, as described above, corresponding to the notch portion 51*g* formed by partially penetrating and removing the thick portion 51*h*, an annular support portion 52*c* is formed. That is, the notch portion 51*g* and the annular support portion 52*c* are overlapped when overlooked. In order to achieve shading of the shielding device 50, the drive shaft 54 can be rotated, the forced draft fan cover 51 is declined, and a lower end of the side surface portion 51*e* of the forced draft fan cover 51 abuts against the frame portion 52*a*. Accordingly, shutoff of the forced draft fan cover 51 is achieved. At this point, an upper surface of the annular support portion 52*c* abuts against a lower end of the thick portion 51*h*. Accordingly, as internal space of the forced draft fan cover 51 and the outside cannot be connected through the notch portion 51*g*, the notch portion 51*g* will not affect the shutoff.

Figure 3C:
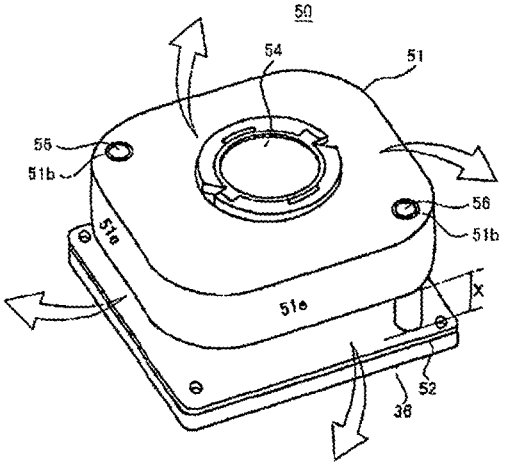
Figure 3D:
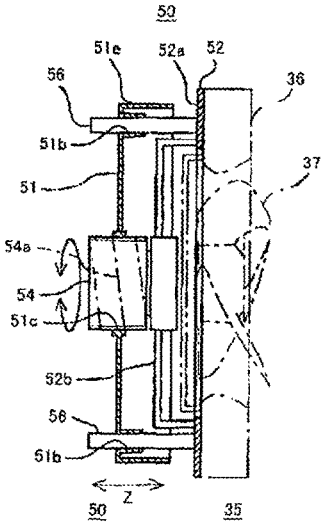

The action of the shielding device 50 is described below with reference to FIGS. 3A-3D. FIG. 3A is a perspective view indicating that the shielding device 50 is in a closed state (shutoff state). FIG. 3B is a sectional view indicating that the shielding device 50 is in the closed state. FIG. 3C is a perspective view indicating that the shielding device 50 is in an open state. FIG. 3D is a sectional view indicating that the shielding device 50 is in the open state.

Referring to FIGS. 3A and 3B, in this embodiment, the side surface portion 51*e* of the forced draft fan cover 51 of the shielding device 50 abuts against the support base 52, thus producing an effect of shading them seamlessly. Through rotation of the drive shaft 54, conversion from a connection state (open state) of the shielding device 50 to a shaded state can be achieved. That is, in a state that the forced draft fan cover 51 and the support base 52 of the shielding device 50 are separated, the drive shaft 54 is rotated counterclockwise, and in a state that the thread 54*a* of the drive shaft 54 is screwed with the threaded slot disposed on the threaded hole 51*c* of the forced draft fan cover 51, the forced draft fan cover 51 moves to the side of the support base 52. Moreover, with the side surface portion 51*e* of the forced draft fan cover 51 contacting the support base 52, space encircled by the forced draft fan cover 51 is shaded from outside. Accordingly, the air supply outlet 13*a* shown in FIG. 7 is closed through the shielding device 50, and the cooling chamber 13 is not communicated with the refrigerating chamber supply air duct 14*a*, to inhibit leakage of hot air during defrosting.

Referring to FIGS. 3C and 3D, by separating the forced draft fan cover 51 of the shielding device 50 from the support base 52, a gap is formed between them, to become a connection state. By rotating the drive shaft 54 counterclockwise, the forced draft fan cover 51 can be moved towards a direction (Z direction) separated from the support base 52, so as to convert from a shaded state to a connection state. Accordingly, a gap is formed between the side surface portion 51*e* of the forced draft fan cover 51 and the frame portion 52*a* of the support base 52, and internal space of the forced draft fan cover 51 is in communication with the outside via the gap. Moreover, when the fan 37 rotates in the state, air flow can be sent to the outside via the gap formed between the forced draft fan cover 51 and the support base 52. In addition, in FIG. 3C, a path through which cool air is supplied between the forced draft fan cover 51 and the support base 52 has been marked with arrows. Accordingly, at the air supply outlet 13*a* shown in FIG. 7, the cooling chamber 13 can communicate with the refrigerating chamber supply air duct 14*a* by releasing shutoff of the shielding device 50, so that cool air can be supplied for the air duct from the cooling chamber 13.

Second Embodiment: Structure of a Refrigerator

Figure 4:
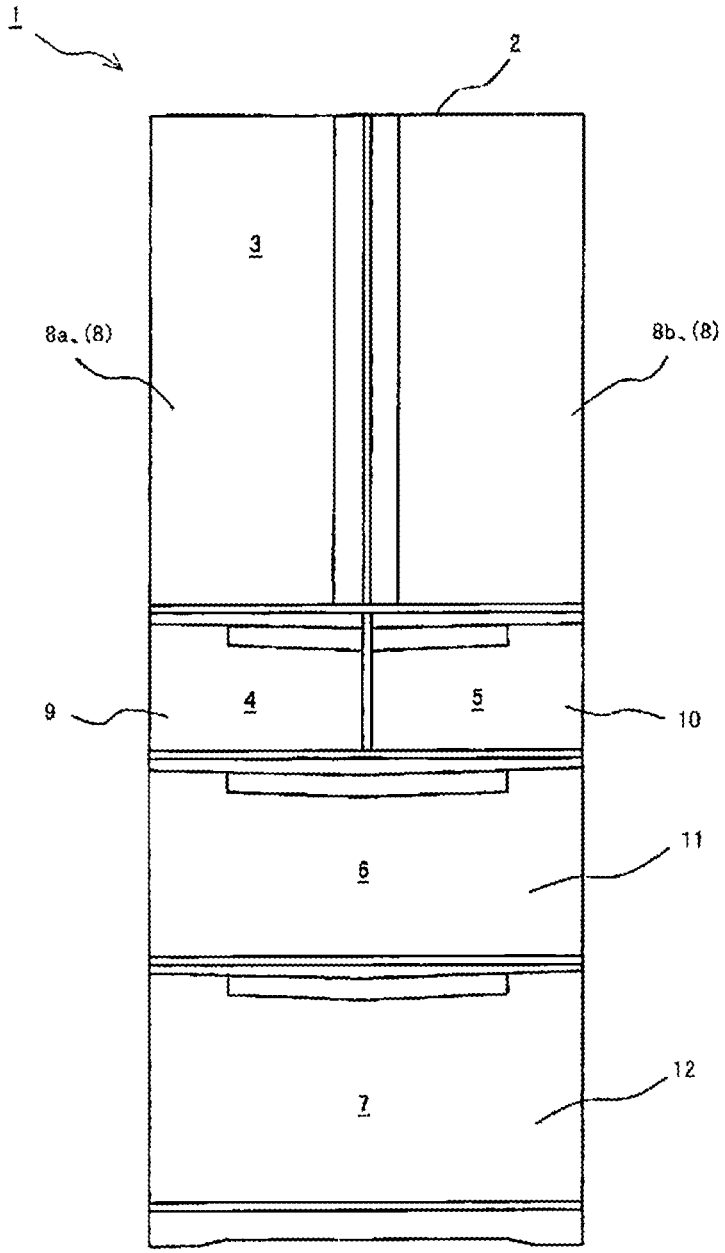
FIG. 4 is a forward external view of a refrigerator according to one embodiment of the present invention.

Referring to FIG. 4, a forward external view of a schematic structure of a refrigerator 1 is shown according to one embodiment of the present invention. As shown in FIG. 4, the refrigerator 1 of this embodiment has a heat-insulating cabinet 2 as a body, and a storage chamber that stores food and the like is formed inside the heat-insulating cabinet 2. The inside of the storage chamber is partitioned into multiple receiving chambers 3-7 according to different storage temperatures and uses. The uppermost layer of the storage chamber is a refrigerating chamber 3. An ice-making chamber 4 is on a lower left side of the refrigerating chamber 3, while an upper freezing chamber 5 is on a lower right side of the refrigerating chamber 3. A lower layer of the ice-making chamber 4 and the upper freezing chamber 5 is a lower freezing chamber 6. The lowest layer of the storage chamber is a vegetable chamber 7. Besides, the ice-making chamber 4, the upper freezing chamber 5 and the lower freezing chamber 6 are receiving chambers whose temperatures are within a range of freezing temperatures, which, in later description, are collectively called an ice-making chamber.

A front side opening of the heat-insulating cabinet 2 and openings corresponding to the receiving chambers 3-7 are respectively provided with heat-insulating doors 8-12 that can be opened and closed. The heat-insulating doors 8*a* and 8*b* separately cover the front side of the refrigerating chamber 3, and left upper and lower portions of the heat-insulating door 8*a* and right left upper and lower portions of the heat-insulating door 8*b* are rotatably supported to the heat-insulating cabinet 2. In addition, the heat-insulating doors 9-12 are respectively combined with corresponding receiving containers into a whole, so as to be capable of being supported to the heat-insulating cabinet 2 in a pull-out manner in front of the refrigerator 1.

Figure 5:
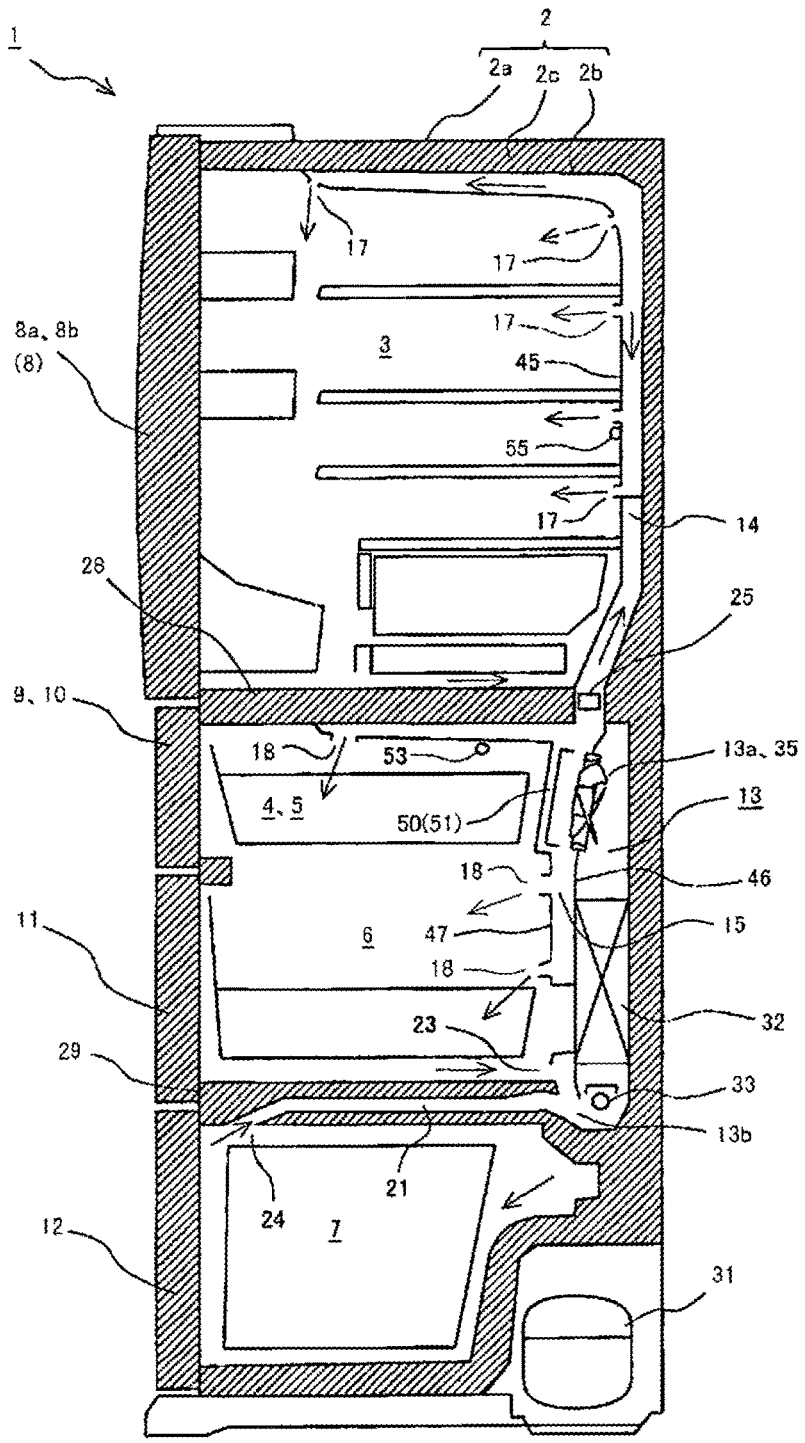
FIG. 5 is a side sectional view of a schematic structure of a refrigerator according to one embodiment of the present invention.

FIG. 5 is a side sectional view of a schematic structure of the refrigerator 1. The heat-insulating cabinet 2 as the body of the refrigerator 1 includes a steel plate housing 2*a* opened at a front side, a synthetic resin liner 2*b* disposed in the housing 2*a* with a gap and opened at a front side, and a foaming polyurethane heat-insulating material 2*c* formed by filling and foaming in a gap between the housing 2*a* and the liner 2*b*. Besides, the heat-insulating doors 8-12 may also adopt a heat-insulating structure the same as the heat-insulating cabinet 2.

The refrigerating chamber 3 is separated from the ice-making chambers 4-6 located therebelow by heat-insulating partition walls 28. The ice-making chamber 4 and the upper freezing chamber 5 inside the ice-making chambers 4-6 are separated by partition walls (not shown). In addition, the ice-making chamber 4 and the upper freezing chamber 5 are in communication with the lower freezing chamber 6 disposed below them, and cool air can circulate therebetween. Moreover, the ice-making chambers 4-6 and the vegetable chamber 7 are separated by heat-insulating partition walls 29.

A rear side of the refrigerating chamber 3 is formed with a refrigerating chamber supply air duct 14 formed by separation of a synthetic resin partition body 45 and serving as a supply air duct that supplies cool air for the refrigerating chamber 3. The refrigerating chamber supply air duct 14 is formed with a blowout port 17 that allows the cool air to flow into the refrigerating chamber 3. In addition, the refrigerating chamber supply air duct 14 is provided thereon with a refrigerating chamber air door 25. The refrigerating chamber air door 25 is an air door that can be opened and closed under the driving of a motor and the like, used for controlling the flow rate of the cool air supplied to the refrigerating chamber 3, so as to keep the inside of the refrigerating chamber 3 at an appropriate temperature.

Rear sides of the ice-making chambers 4-6 are formed with a freezing chamber supply air duct 15, used for allowing the cool air cooled by the refrigerating chamber 3 to flow to the ice-making chambers 4-6. A more rear side of the freezing chamber supply air duct 15 is formed with a cooling chamber 13, inside which is provided with a cooler 32 (evaporator) used for cooling circulating air in the refrigerator.

The cooler 32 is connected with a compressor 31, a radiator (not shown) and an expansion valve (capillary tube, not shown) via a refrigerant piping, to make up a vapor-compression refrigeration circulation loop. In addition, in the refrigerator 1 according to this embodiment, iso-butane (R600a) is used as a refrigerant of the refrigeration circulation.

In addition, the refrigerator 1 includes a refrigerating chamber temperature sensor 55 used for detecting an inside temperature of the refrigerating chamber 3, a freezing chamber temperature sensor 53 used for detecting inside temperature of the ice-making chambers 4-6 and other various sensors not shown.

Further, the refrigerator 1 includes a control device not shown, and the control device executes specified algorithm processing based on input values of the sensors, to control the compressor 31, the forced draft fan 35, the shielding device 50, the refrigerating chamber air door 25 and other components.

Figure 6:
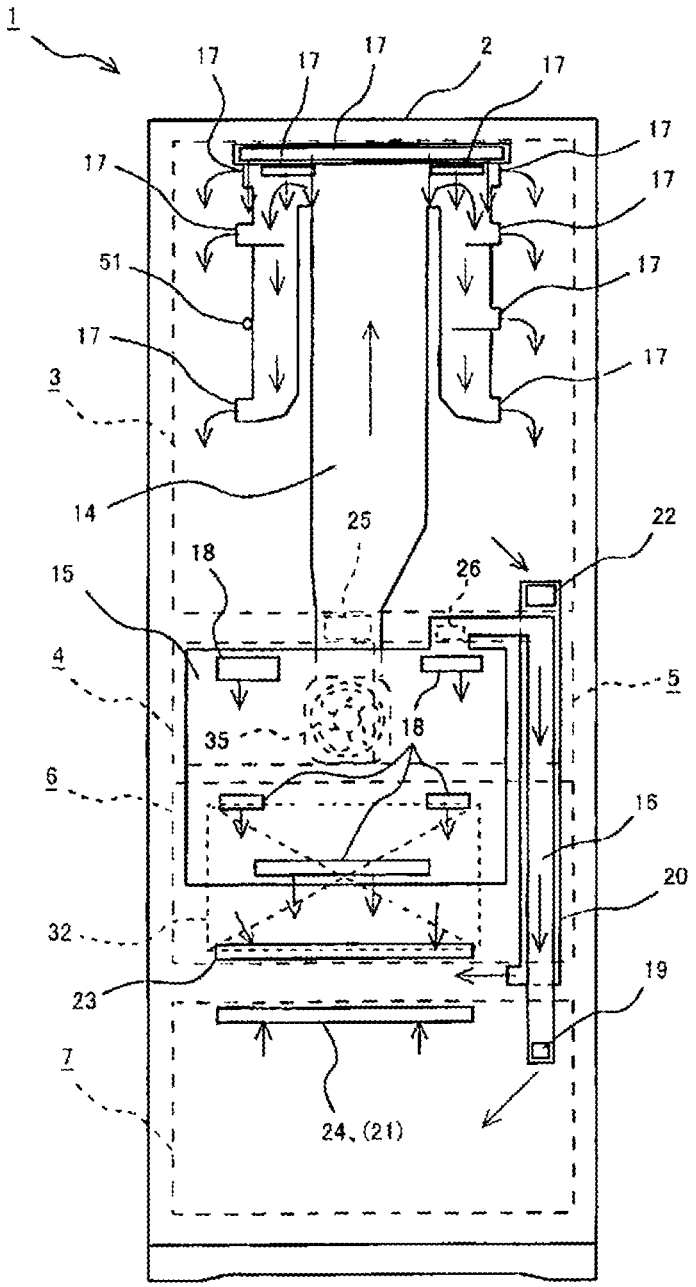
FIG. 6 is a forward schematic view of a supply air duct of a refrigerator according to one embodiment of the present invention.

FIG. 6 is a forward schematic view of a schematic structure of a supply air duct of the refrigerator 1. The refrigerating chamber supply air duct 14 transports the cool air to the uppermost portion at the central portion of the refrigerating chamber 3, and then makes the cool air decline from two sides, to supply the cool air into the refrigerating chamber 3. Accordingly, the cool air can be effectively supplied to the whole inside of the refrigerating chamber 3.

The refrigerator 1 includes a return air duct 20 that makes the air flow back to the cooling chamber 13 from the refrigerating chamber 3. A lower portion of the refrigerating chamber 3 is formed with a return air inlet 22, and the return air inlet 22 is an opening through which the refrigerating chamber 3 leads to the return air duct 20. The air in the refrigerating chamber 3 flows to the return air duct 20 via the return air inlet 22, and flows to the lower side of the cooler 32.

In addition, the front of the return air duct 20 is formed with a vegetable chamber supply air duct 16 that allows the air cooled by the cooler 32 to flow to the vegetable chamber 7. The vegetable chamber supply air duct 16 forks from the freezing chamber supply air duct 15 towards the upper side, and after extending to pass through the inside of the heat-insulating partition walls 28 (referring to FIG. 5) above the ice-making chambers 4-6, changes to extend downwards from the rear sides of the ice-making chambers 4-6. Then, it passes through the heat-insulating partition wall 29 (referring to FIG. 5) to communicate to the vegetable chamber 7. The vegetable chamber 7 is formed with a blowout port 19, and the blowout port 19 is an opening that supplies the cool air from the vegetable chamber supply air duct 16 to the vegetable chamber 7.

The vegetable chamber supply air duct 16 is provided with a vegetable chamber air door 26, used for controlling the flow rate of the cool air supplied to the vegetable chamber 7. Accordingly, the vegetable chamber 7 can be cooled independent of cooling of the refrigerating chamber 3, so as to properly control the temperature of the vegetable chamber 7.

In addition, it is also feasible to construct the vegetable chamber supply air duct 16 to fork from a side or a lower side of the freezing chamber supply air duct 15. Accordingly, the vegetable chamber supply air duct 16 can be shortened, to reduce pressure loss.

In addition, it is feasible to connect the vegetable chamber supply air duct 16 with the return air duct 20 that returns the cool air from the refrigerating chamber 3. In this way, the vegetable chamber supply air duct 16 can be constructed to fork from the return air duct 20, and the cost can be reduced by omitting the vegetable chamber air door 26.

A return air inlet 24 is formed on the vegetable chamber 7, and the air in the vegetable chamber 7 flows towards the lower portion of the cooling chamber 13 via a return air duct 21 and a return air inlet 13*b* of the vegetable chamber.

FIG. 7 is a side sectional view of a structure near the cooling chamber 13 of the refrigerator 1. The cooling chamber 13 is disposed in a rear side of the freezing chamber supply air duct 15 inside the heat-insulating cabinet 2. The cooling chamber 13 is separated from the freezing chamber supply air duct 15 or the synthetic resin partition body 46 between the ice-making chambers 4-6. That is, the cooling chamber 13 is space sandwiched by the liner 2*b* and the partition body 46.

The freezing chamber supply air duct 15 formed in the front of the cooling chamber 13 is space formed between the partition body 46 and a synthetic resin front cover 47 assembled to the front thereof, used as an air duct where the cool air cooled by the cooler 32 flows. A blowout port 18 is formed on the front cover 47, used as an opening that blows out cool air to the ice-making chambers 4-6.

The back of the lower portion of the lower refrigerating chamber 6 is formed with a return air inlet 23 that allows air to return to the cooling chamber 13 from the ice-making chambers 4-6. Moreover, a return air inlet 13*b* is formed below the cooling chamber 13, which is connected with the return air inlet 23, and sucks return cool air from the storage chamber into the inside of the cooling chamber 13.

In addition, a defrost heater 33 is disposed below the cooler 32, used as a defrost device that melts and removes frost attached to the cooler 32. The defrost heater 33 is a resistance-heated heater. In addition, regarding the defrosting means, it is also feasible to use, for example, other defrosting manners such as shutdown defrosting or hot gas defrosting without an electric heater.

An air supply outlet 13*a* is formed on the partition body 46 in the upper portion of the cooling chamber 13, used as an opening connected with the refrigerating chambers 3-7.

That is, the air supply outlet 13*a* is an opening that allows the cool air cooled by the cooler 32 to flow, and connects the cooling chamber 13, the refrigerating chamber supply air duct 14, the freezing chamber supply air duct 15 and the vegetable chamber supply air duct 16 (referring to FIGS. 3A-3D). The air supply outlet 13*a* is provided with a forced draft fan 35 that transports cool air to the ice-making chambers 4-6.

The forced draft fan 35 is an axial forced draft fan, and has a rotary fan 37 (propeller fan) and a fan shell 36, and the fan shell 36 is formed with a wind tunnel 36*a* substantially opened cylindrically. The fan shell 36 is mounted to the air supply outlet 13*a* of the cooling chamber 13, and is a member that becomes a border between the suction side and the air outside of the forced draft fan 35.

Moreover, a fan 37 is provided coaxially with the wind tunnel 36*a* on the fan shell 36. Besides, the end portion of the air outside of the fan 37 is disposed as much closer to the outer side than the end portion of the air outside of the wind tunnel 36*a*, that is, than the end face of the air outside of the fan shell 36, i.e., much closer to the air outside or the side of the freezing chamber supply air duct 15. Accordingly, flow resistance of exhaust air flowing along a turning radius direction of the fan 37 becomes small, and cool air can be sent out with smaller flow loss.

In addition, an outer side of the air supply outlet 13*a* of the cooling chamber 13, i.e., an air outside of the forced draft fan 35, is provided with a shielding device 50, and the shielding device 50 is used for closing a forced draft fan cover 51 of the air supply outlet 13*a*. The shielding device 50 is mounted to make the support base 52 to closely contact, for example, with the fan shell 36 of the forced draft fan 35.

The forced draft fan cover 51 is substantially cover-shaped. Accordingly, the forced draft fan cover 51 may not contact the fan 37 more projecting towards the air outside than the fan shell 36, and can abut against the support base 52 on the outer side of the wind tunnel 36*a*, so as to close the air supply outlet 13*a*.

Figure 8A:
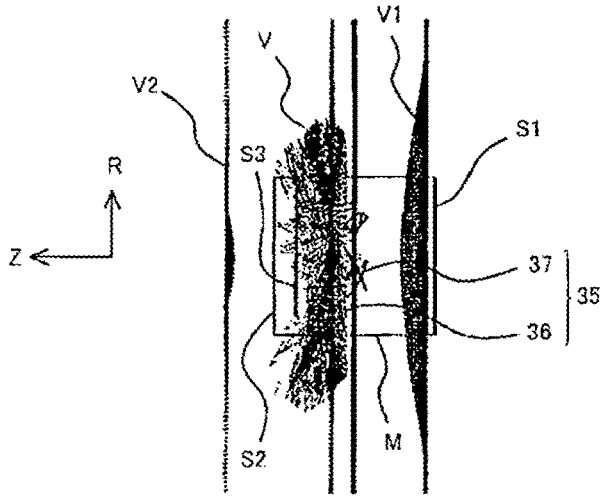
FIGS. 8A-8C are illustrative schematic views of air flow analysis results surrounding an axial forced draft fan under different conditions, wherein FIG. 8A a pressure difference of an air outside and a suction side is 12 Pa, FIG. 8B the pressure difference of the air outside and the suction side is 4 Pa, and FIG. 8C the pressure difference of the air outside and the suction side is 2 Pa.
Figure 8B:
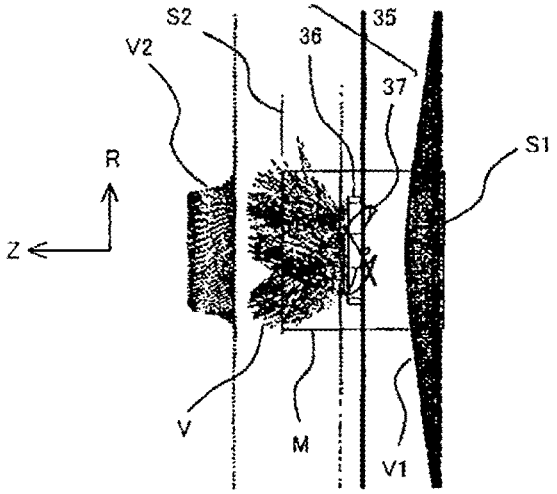
Figure 8C:
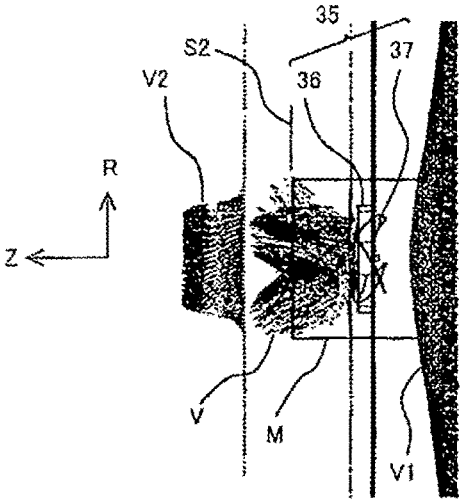
Figure 9:
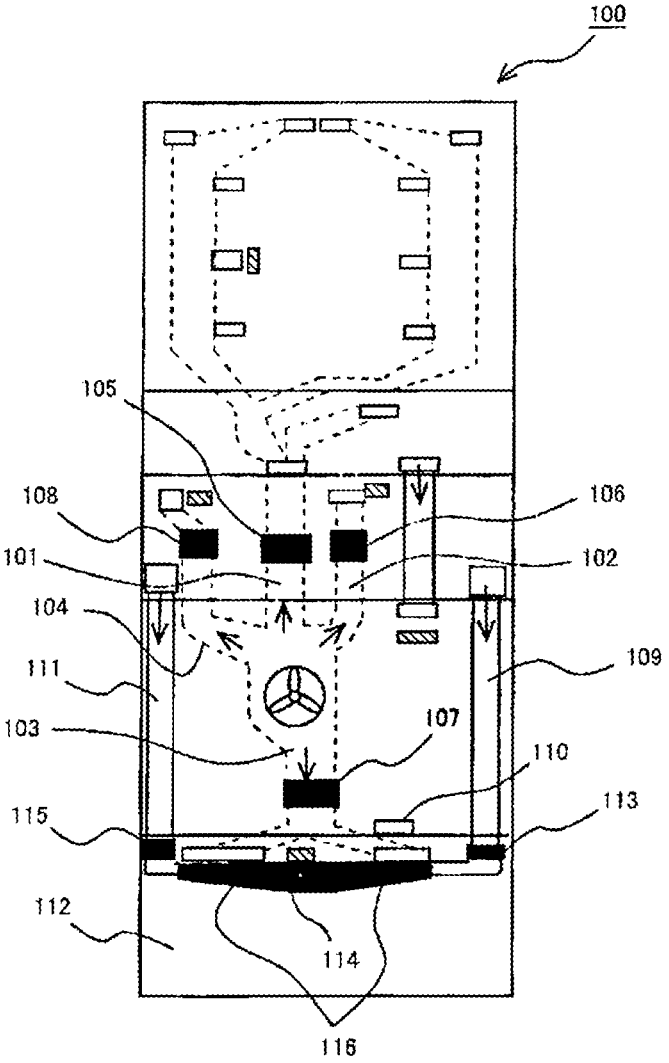
FIG. 9 (Prior Art)
FIG. 9 is a front view of one example of a prior art refrigerator.
Figure 10A:
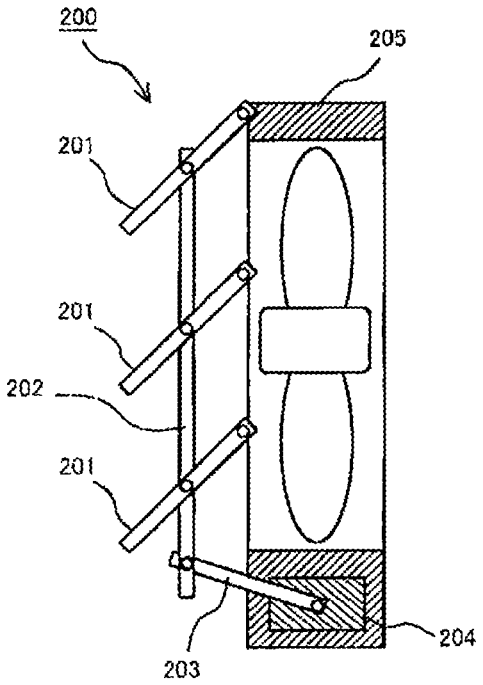
FIG. 10A (Prior Art)
Figure 10B:
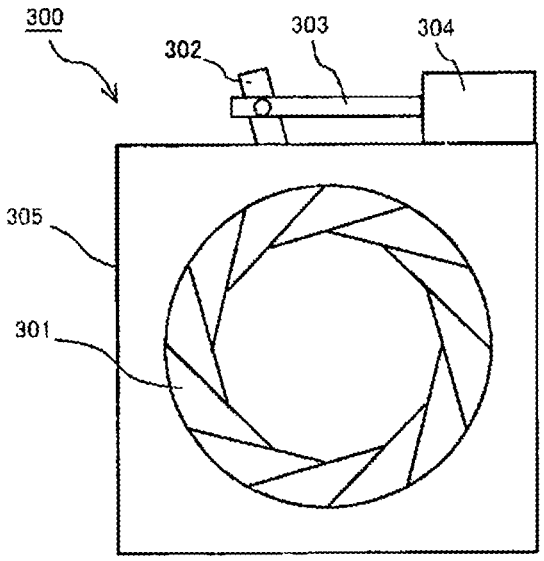
FIG. 10B (Prior Art)

Herein, air flow surrounding the forced draft fan 35 is described in more detail with reference to FIGS. 8A-8C. FIGS. 8A-8C are illustrative schematic views of analysis results of air flow under different conditions around the axial forced draft fan serving as the forced draft fan 35, wherein FIG. 8A is an analysis result when a pressure difference of the out-air side and the suction side is 12 Pa, FIG. 8B is an analysis result when the pressure difference is 4 Pa, and FIG. 8C is an analysis result when the pressure difference is 2 Pa.

In FIGS. 8A-8C, a sign V is wind velocity vector distribution on a surface (referring to FIG. 6) of the frame portion 52*a* of the support base 52. In addition, in the case that the support base 52 is not mounted to the fan shell 36, the sign V is equivalent to wind velocity vector distribution on the air outside end face of the fan shell 36. In addition, a sign V1 indicates wind velocity vector distribution on a surface 51 at the suction side (right side of the paper), and a sign V2 indicates wind velocity vector distribution on a surface S2 at the air outside (left side of the paper). The wind velocity vectors V, V1 and V2 are represented as: arrow directions are taken as directions of the air flow, and the arrow length is in proportion to the velocity of the air flow. In addition, in the figures, transverse lines M drawn above and below the fan 37 are lines used to facilitate calculation, but are not used to describe analysis results, and the transverse lines M can be ignored.

It can be known from FIG. 8C that, in the event that the pressure difference of the out-air side and the suction side of the forced draft fan 35 is 2 Pa, the wind velocity vector V of the out-air side of the forced draft fan 35 is slightly tilted relative to the up-down direction of the figure, but is basically towards the left side. In addition, the wind velocity vector V2 on the surface S2 of the air outside also projects towards the left side. It can be seen that in the condition that the pressure difference is 2 Pa, the air flow of the air outside of the forced draft fan 35 flows at a greater speed in a rotary shaft direction Z of the fan 37, and at a smaller speed in a turning radius direction R. In other words, the air discharged by the forced draft fan 35 mainly flows to the front of the forced draft fan 35.

However, as shown in FIG. 8B, if the pressure difference of the out-air side and the suction side of the forced draft fan 35 is 4 Pa, expansion of the wind velocity vector V of the out-air side of the forced draft fan 35 slightly becomes large in the up-down direction of the figure, and the wind velocity vector V2 on the surface S2 of the air outside becomes short. That is, if the pressure difference becomes large to 4 Pa, the speed of the air flow of the air outside of the forced draft fan 35 in the turning radius direction R of the fan 37 becomes large.

Further, as shown in FIG. 8A, if the pressure difference further becomes large to 12 Pa, the wind velocity vector V of the out-air side of the forced draft fan 35 changes to be basically towards the up-down direction of the figure. In addition, the wind velocity vector V2 on the surface S2 of the air outside becomes very short. It can be seen that in the condition that the pressure difference is 12 Pa, the speed of the air flow blown out by the forced draft fan 35 in the rotary shaft direction Z of the fan 37 becomes very small, and the speed in the turning radius direction R becomes large. In other words, the air flow blown out by the forced draft fan 35 will not flow to the front (i.e., Z direction) of the forced draft fan 35, but flows to the turning radius direction R.

In addition, under any condition in FIGS. 8A-8C, the air flow of the air outside of the forced draft fan 35 will form a rotational flow that takes the rotary shaft of the fan 37 as the center.

The above describes the characteristics of the axial forced draft fan that serves as the forced draft fan 35, and according to the illustration of the refrigerator 1 of this embodiment, in the refrigerator where cool air is forced to circulate in a closed loop, the pressure difference of the out-air side and the suction side of the forced draft fan 35 is about 10-12 Pa. That is to say, as shown in FIG. 8A, the cool air blown out by the forced draft fan 35 will expand and flow towards the turning radius direction R of the fan 37 of the forced draft fan 35.

Therefore, the forced draft fan cover 51 according to this embodiment moves in a manner of leaving the cooling chamber 13 when cooling the ice-making chambers 4-6, and an opening used for flowing of the cool air will be formed between the forced draft fan cover 51 and the cooling chamber 13. Thus, as described above, the air at a greater flow velocity in the turning radius R blown out by the forced draft fan 35 will, along the fan shell 36 and the partition body 46 through the opening, flow into the freezing chamber supply air duct 15 (and the refrigerating chamber supply air duct 14) with very small flow resistance.

At this point, as shown in FIG. 8A, because the air flowing to the front of the forced draft fan 35 is very small at the beginning, the forced draft fan cover 51 that has been moved to leave the cooling chamber 13 have little influence on the resistance of the air duct.

In addition, as shown in FIG. 3C, in order that pressure loss caused by the forced draft fan cover 51 does not increase, it is necessary to ensure that a distance X (i.e., the distance X forming an air flow path opening) between the primary surface of the support base 52 and the side end face of the forced draft fan 35 of the forced draft fan cover 51 has a particular length. Specifically, the distance X should be ensured to be more than 30 mm and preferably more than 50 mm. If the distance X is shorter than 30 mm, flow loss caused by the forced draft fan cover 51 will increase, and compared with the situation where the prior art uses air doors and the like, it is difficult to inhibit the pressure loss to be less.

On the other hand, if it is ensured that the distance X is more than 50 mm, increase of the pressure loss caused by the forced draft fan cover 51 can be almost eliminated. To this, reference can be made to the brief description of FIG. 8A, and a surface S3 of the air outside shown in the figure is in a position where the distance X (referring to FIG. 3C) is equal to 50 mm. In addition, the surface S2 is in a position where the distance X is equal to 80 mm. It can be known from the figure that, as long as the position from the opening to the surface S3 is ensured, i.e., to the position where the distance X is equal to 50 mm, the air flow is hardly hindered when passing through the opening.

Third Embodiment: Working Process of the Refrigerator

In the following, the working process of the refrigerator 1 having the above structure is described with reference to the figures mentioned above.

First, the operation of cooling the refrigerating chamber 3 is described. As shown in FIG. 5, the compressor 31 operates, the refrigerating chamber air door 25 is opened, to make the forced draft fan 35 operate, and thus the refrigerating chamber 3 is cooled. That is, air cooled by the cooler 32 sequentially passes through the air supply outlet 13*a* (forced draft fan 35) of the cooling chamber 13, the refrigerating chamber air door 25, the refrigerating chamber supply air duct 14 and the blowout port 17, to be supplied to the refrigerating chamber 3. Accordingly, food and the like stored in the refrigerating chamber 3 can be cooled and stored at an appropriate temperature.

At this point, referring to FIG. 7, the shielding device 50 becomes an open state, and the cooling chamber 13 and the refrigerating chamber supply air duct 14*a* become a connection state. That is, the shielding device 50, as shown in FIG. 3C, is separated from the forced draft fan cover 51 and the support base 52, and the cooled air is supplied to the refrigerating chamber 3 from a gap therebetween.

Moreover, circulating cool air supplied into the refrigerating chamber 3, as shown in FIG. 6, returns into the cooling chamber 13 via the return air duct 20 from the return air inlet 22. Therefore, the cooler 32 cools it once again.

Next, the operation of cooling the ice-making chambers 4-6 is described. As shown in FIG. 5, the compressor 31 operates, the forced draft fan 35 operates, the forced draft fan cover 51 is opened, and thus the ice-making chambers 4-6 can be cooled. Specifically, the forced draft fan cover 51 is in a state of leaving the support base 52 as shown in FIG. 3C. Accordingly, air cooled by the cooler 32 is sent out via the forced draft fan 35 disposed at the air supply outlet 13*a* of the cooling chamber 13, sequentially passes through the freezing chamber supply air duct 15 and the blowout port 18, and is supplied to the ice-making chambers 4-6.

Therefore, food and the like stored in the ice-making chambers 4-6 can be cooled and stored at an appropriate temperature. Moreover, the air in the ice-making chambers 4-6, through the return air inlet 23 formed in a rear side of the lower refrigerating chamber 6, flows back to the cooling chamber 13 via the return air inlet 13*b* of the cooling chamber 13.

Next, cool air supply for the vegetable chamber 7 is described. By opening the vegetable chamber air duct 26, one part of the air sent to the freezing chamber supply air duct 15 by using the forced draft fan 35 flows to the vegetable chamber supply air duct 16 as shown in FIG. 6, and then is blown to the vegetable chamber 7 from the blowout port 9. Accordingly, the inside of the vegetable chamber 7 can be cooled. Moreover, the cool air circulating in the vegetable chamber 7 sequentially passes through the vegetable chamber return air duct 21 and the return air inlet 13*b* from the return air inlet shown in FIG. 6 to return to the cooling chamber 13.

As described above, in the refrigerator 1, cool air cooled by one cooler 32 can be efficiently supplied to the refrigerating chambers 3-7 separately with less pressure loss. Accordingly, the refrigerating chamber 3 and the ice-making chambers 4-6 can be properly cooled respectively according to respective cooling load.

In addition, as a cooler specific to refrigeration is not needed in the refrigerator 1, the refrigerating chamber 3 can be enlarged. In addition, a cooling temperature (refrigerant evaporating temperature) of the cooler 32 can be adjusted according to a target cold-keeping temperature of the storage chamber for which cool air should be supplied, which can thus further increase efficiency of refrigeration cycle.

Next, the action performed during the defrosting operation is described. Referring to FIG. 5, if a cooling operation is performed continuously, frost will be attached to an air side heat-transfer surface of the cooler 32, which hinders heat transfer and will block an air flow path. Therefore, after frosting is judged from reduction of the refrigerant evaporating temperature or the like or frosting is judged by a defrost timer or the like, a defrosting and cooling operation or a defrosting operation begins, to remove the frost attached to the cooler 32.

First, the defrosting and cooling operation of cooling the refrigerating chamber 3 by using latent heat of the frost attached to the cooler 32. When the defrosting and cooling operation is performed, the compressor 31 stops operating, to form a state where the forced draft fan cover 51 is opened as shown in FIG. 3C. Afterwards, the refrigerating chamber air duct 25 is opened, to make the forced draft fan 35 operate.

Accordingly, air can circulate between the refrigerating chamber 3 and the cooling chamber 13, and the frost attached to the cooler 32 is melted by using the circulating air. That is, defrosting can be performed without heating of the defrost heater 33. Meanwhile, the refrigerating chamber 3 can be cooled without letting the compressor 31 operate, but by using heat of melting of the frost.

That is to say, heater input used for defrosting and compressor input used for cooling can be reduced, to reduce power consumption of the refrigerator 1, and comprehensively increase cooling efficiency. In addition, as it is possible to supply cool air with higher humidity brought about by defrosting to the refrigerating chamber 3, food and the like stored therein can be prevented from drying, to increase fresh-keeping effects. In addition, by disposing a supply air duct that supplies cool air to the vegetable chamber 7 without through the freezing chamber supply air duct 15, cooling by using latent heat of the defrosting and moisture replenishing can be performed thereon even for the vegetable chamber 7.

At this point, referring to FIG. 5, as cool air containing lots of moisture passes through the shielding device 50, a situation that lots of moisture is attached to the shielding device 50 may occur. However, referring to FIG. 1 and the like, as described above, the shielding device 50 of this embodiment has many structures used for discharging the attached moisture, and a situation where the action of the drive shaft 54 is hindered due to the moisture will not occur. That is, referring to FIGS. 1 and 2A-2C, even if moisture enters between the forced draft fan cover 51 and the drive shaft 54, as it is ensured that an air duct exists between them, good drainage can be achieved by letting the air pass through the air duct.

In this embodiment, the defrosting and cooling operation is performed in a situation where it is judged that the cooler 32 defrosts and the temperature of the refrigerating chamber 3 is higher than a predetermined threshold. Even if it is detected that the cooler 32 defrosts, when the temperature of the refrigerating chamber 3 is lower than the predetermined threshold, it is unnecessary to cool the refrigerating chamber 3, and thus the defrosting and cooling operation may not be performed, but the conventional defrosting operation is performed by using the defrost heater 33.

The conventional defrosting operation is described below. In the conventional defrosting operation, the compressor 31 stops, and the defrost heater 33 is powered on, so as to melt the frost attached to the cooler 32. At this point, the air supply outlet 13*a* is closed and the refrigerating chamber air door 25 is closed by using the forced draft fan cover 51. That is, through rotation of the drive shaft 54, the shielding device 50 can be changed into the shaded state shown in FIG. 3A. Accordingly, air in the cooling chamber 13 heated by the defrost heater 33 can be prevented from flowing into the refrigerating chamber supply air duct 14 and the like. As a result, cooling efficiency of the refrigerator 1 can be increased.

In addition, if defrosting of the cooler 32 ends, power-on of the defrost heater 33 is stopped, and the compressor 31 is started, so as to begin the cooling performed by a refrigeration loop. Moreover, after it is detected that the cooler 32 and the cooling chamber 13 are cooled to a predetermined temperature, or the timer and the like go on a predetermined time, the forced draft fan cover 51 and the refrigerating chamber air door 25 are opened, and the forced draft fan 35 begins to operate. Accordingly, influences brought about by defrost heat can be inhibited as small as possible, and the cooling operation can begin once again.

Next, an operation of forming an air curtain is described with reference to FIG. 5. If it is detected that the heat-insulating door 8 is in an open state, the refrigerating chamber air door 25 is opened, and the forced draft fan 35 operates. Accordingly, the blowout port 17 formed on a front portion of the upper surface of the refrigerating chamber 3 blows out cool air to the lower side, and an air curtain is formed at a front opening of the refrigerating chamber 3.

In addition, it is also feasible to dispose an opening-adjustable wing plate (not shown) at the blowout port 17 on the front portion of the upper surface of the refrigerating chamber 3. By providing the wing plate and adjusting its angle (opening), a suitable air curtain used for preventing cool air from leaking to the outside from the inside of the refrigerating chamber 3 is formed. Further, the forced draft fan 35 can continuously operate after a period of predetermined time after the heat-insulating door 8 is closed, and the wing plate can also swing. Accordingly, the inside of the refrigerating chamber 3 becoming warmer due to opening of the heat-insulating door 8 can be effectively cooled, especially a receiving wall box 57 on an inner side of the heat-insulating door 8.

As described above, the refrigerator 1 according to this embodiment, during defrosting, can use the forced draft fan cover 51 to close the air supply outlet 13*a* of the cooling chamber 13, and thus hot air during defrosting can be prevented from flowing into the storage chamber.

In addition, the forced draft fan cover 51 according to this embodiment is mounted to an outer side of the air supply outlet 13*a* of the cooling chamber 13, that is, an air outside of the forced draft fan 35, and thus it is universal even if for other models of refrigerators with air ducts in different shapes. At this point, it is feasible to make the forced draft fan cover 51 and the forced draft fan 35 form a structural member integrally assembled for use. Accordingly, no matter which air duct structure it is, leakage of defrosting hot air can be prevented, and thus design freedom of the cooling air duct can be increased, and air duct design can be done easily. Therefore, development cost and product cost of the cooling air duct and the air door can be reduced.

Moreover, in this embodiment, as described above with reference to FIGS. 1 and 2A-2C, even if water and ice are attached to the shielding device 50 in a use condition of the refrigerator, the attached water and the like can be well removed through a tilted structure of the thread 54*a*. Accordingly, a situation where moisture attached to the forced draft fan cover 51 hinders actions can be inhibited.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A shielding device, used for dosing a path through which air circulates in a refrigerator, comprising:

a forced draft fan cover having a quadrilateral primary surface portion and four side surface portions longitudinally extending from a periphery of the quadrilateral primary surface portion, a threaded hole formed by penetrating a vicinity of a center of the quadrilateral primary surface portion, a thick portion being an annular thickened part formed with a peripheral part of the threaded hole, a threaded slot formed by recessing a side surface of the quadrilateral primary surface portion facing the threaded hole into a helical shape, and an interrupt portion formed by partially removing the thick portion at an end of the threaded slot; and a drive shaft formed with a thread being screwed with the threaded slot and extended to pass through the threaded hole;

wherein an air duct that allows the air flows from an inside, of the forced draft fan cover to an outside of the forced draft fan cover is provided between the drive shaft and the forced draft fan cover.

2. The shielding device according to claim 1, further comprising:

a guide post slidably extending to pass through the forced draft fan cover.

3. The shielding device according to claim 1, wherein a notch portion is formed by removing one part of the forced draft fan cover which faces the threaded hole; and the notch portion constitutes one part of the air duct.

4. The shielding device according to claim 3, further comprising:

a support portion abutting against the notch portion when the forced draft fan cover closes a channel so as to close the air duct.

5. The shielding device according to claim 1, wherein a side surface of the thread of the drive shaft is in a tilted shape, and a radial outer side portion of the tilted shape is at a distance from the threaded slot of the forced draft fan cover, wherein the distance is greater than an inner side portion; and the air duct is formed between the side surface of the thread of the drive shaft and the threaded slot of the forced draft fan cover.

6. The shielding device according to claim 5, further comprising:

a guide post slidably extending to pass through the forced draft fan cover.

7. The shielding device according to claim 5, wherein a notch portion is formed by removing one part of the forced draft fan cover which faces the threaded hole; and the notch portion constitutes one part of the air duct.

8. The shielding device according to claim 7, further comprising:

a support portion abutting against the notch portion when the forced draft fan cover closes a channel, so as to close the air duct.

9. A refrigerator, comprising;

a shielding device comprising;

a forced draft fan cover having a quadrilateral primary surface portion and four side surface portions longitudinally extending from a periphery of the quadrilateral primary surface portion, a threaded hole formed by penetrating a vicinity of a center of the quadrilateral primary surface portion, a thick portion being an annular thickened part formed with a peripheral part of the threaded hole, a threaded slot formed by recessing a side surface of the quadrilateral primary surface portion facing the threaded hole into a helical shape, and an interrupt portion formed by partially removing the thick portion at an end of the threaded slot; and a drive shaft formed with a thread being screwed with the threaded slot and extended to pass through the threaded hole;

wherein an air duct that allows the air flows from an inside of the forced draft fan cover to an outside of the forced draft fan cover is provided between the drive shaft and the forced draft fan cover.

* * * * *